US006170554B1

(12) United States Patent
Turner

(10) Patent No.: US 6,170,554 B1
(45) Date of Patent: Jan. 9, 2001

(54) APPARATUS AND METHOD FOR A WINDOW SHUTTER SYSTEM

(75) Inventor: Jean A. Turner, Jacksonville, TX (US)

(73) Assignee: Turner Shutter Company, Tyler, TX (US)

( * ) Notice: Under 35 U.S.C. 154(b), the term of this patent shall be extended for 0 days.

(21) Appl. No.: 09/225,177

(22) Filed: Jan. 4, 1999

(51) Int. Cl.[7] ..... E06B 9/24
(52) U.S. Cl. ..... 160/377; 160/371; 160/381
(58) Field of Search ..... 160/117, 118, 160/210, 213, 369, 371, 372, 119, 374, 377, 378, 381, 135, 351, 379, 335

(56) References Cited

U.S. PATENT DOCUMENTS

| | | | | |
|---|---|---|---|---|
| 1,008,685 | * | 11/1911 | Wildman | 160/335 |
| 1,240,581 | * | 9/1917 | Kirsch et al. | 160/377 |
| 2,182,396 | * | 12/1939 | Copp . | |
| 2,321,216 | * | 6/1943 | Lesko | 160/377 |
| 3,125,155 | * | 3/1964 | Frommelt et al. | 160/377 |
| 4,195,681 | | 4/1980 | Douglas et al. | 160/371 |
| 4,205,486 | | 6/1980 | Guarnacci | 49/501 |
| 5,307,858 | | 5/1994 | Turner | 160/213 |
| 5,547,010 | * | 8/1996 | Stuart | 160/335 |
| 5,657,809 | * | 8/1997 | Longoria et al. | 160/377 |

FOREIGN PATENT DOCUMENTS

| | | |
|---|---|---|
| 2800698A1 | 7/1978 | (DE) . |
| 2810526A1 | 9/1978 | (DE) . |
| 19603770A1 | 8/1997 | (DE) . |
| 9728340 | 8/1997 | (WO) . |

* cited by examiner

*Primary Examiner*—Blair M. Johnson
(74) *Attorney, Agent, or Firm*—BakerBotts L.L.P.

(57) ABSTRACT

An apparatus and method for a window shutter system are disclosed. A window shutter system (100) is disclosed that includes a plurality of shutter frames (106, 108). Each shutter frame (106, 108) includes a plurality of elongate members (126, 130). Each of these elongate members (126, 130) has two ends, and each end has a receiver (204, 208). The shutter frames (106, 108) also include a plurality of couplers (128, 120, 132, 140). Each coupler (128, 120, 132, 140) has at least two extensions (202, 206) for connecting adjacent elongate members. These extensions (202, 206) are adapted to interlock with the receiver (204, 208) of an associated elongate member (126, 130) such that the elongate members (126, 130) and the couplers (128, 120, 132, 140) cannot rotate relative to one another. In addition to the shutter frames (106, 108), the shutter system (100) also includes at least one hinge (112, 114) that may be used to couple one of the elongate members (126, 130) to a window frame (110). The shutter system (100) further includes at least one joint (132, 136) that is used to hingedly connect the various frames (106, 108).

A method for assembling a window shutter system (100) is also disclosed. The method entails assembling at least one frame (106, 108) by connecting a plurality of elongate members (126, 130) using a plurality of couplers (128, 120, 132, 140). The connections between the elongate members (126, 130) and the couplers (128, 120, 132, 140) are made such that the elongate members (126, 128) and the couplers (128, 120, 132, 140) cannot rotate relative to one another. The method also entails attaching at least one hinge (112, 114) to the frame (106) for mounting the shutter system (100) to a window (110).

12 Claims, 2 Drawing Sheets

100
214
212
128c
210
132
219
120
202
204
216
218
118
126a
222
134
212
138
128h
224
208
130b
206
128b
104

APPARATUS AND METHOD FOR A WINDOW SHUTTER SYSTEM

TECHNICAL FIELD OF THE INVENTION

This invention relates generally to the field of window treatments and more particularly to an apparatus and method for a window shutter system.

BACKGROUND OF THE INVENTION

Window shutters have been used for many years to cover window openings. Purposes of such window shutters include functional purposes such as blocking out light and maintaining privacy, and aesthetic purposes such as decorating the home or office. Originally, window shutters were constructed completely of wood. Such shutters typically include a wood frame with wood blinds mounted inside the frame. There are several disadvantages to this approach. These wooden window shutters are usually purchased pre-assembled, and are often bulky and expensive. Such shutters also are often required to be custom made and must usually be installed by a professional.

Later, window shutters were developed that consisted of a frame made of wood with a fabric insert. While this type of shutter is typically less expensive than the all-wood type, it suffers from the other disadvantages of the previous wood shutters.

Window shutters have also been provided that are sold to the user in unassembled component form. The purchaser then has the option of customizing some portions of the shutter before assembly so as to fit a desired window. An example of such a window shutter can be found in U.S. Pat. No. 5,307,858. The frame of the shutters is typically made of metal. The various tubular members that form the frame may be connected with corner connectors that are shaped to receive the circular cross-section of the frame members. While this type of modular shutter system provides a relatively inexpensive window shutter that can be installed by the purchaser, it still has some disadvantages. First, the use of a metal frame makes sizing of the frame members more difficult, and it makes the frame heavy and relatively expensive. In addition, the circular cross-section of the frame members allows the members to rotate inside the corner connectors, and thus causes the frame to bend. Finally, while the use of corner connectors allows for ease of assembly, such connectors do not provide a means to securely connect the frame members in such a way that the shutter can be easily assembled and disassembled.

Therefore, a need has arisen for a new apparatus and method for a window shutter system that overcomes the disadvantages and deficiencies of the prior art.

SUMMARY OF THE INVENTION

An apparatus for a window shutter system is disclosed. The window shutter system includes a plurality of shutter frames. Each shutter frame includes a plurality of elongate members. Each of these elongate members has two ends, and each end has a receiver. The shutter frames also include a plurality of couplers. Each coupler has at least two extensions for connecting adjacent elongate members. These extensions are adapted to interlock with the receiver of an associated elongate member such that the elongate members and the couplers cannot rotate relative to one another. The frames are also configured so as to allow the vertical and horizontal sections of the frame to be uncoupled and recoupled without the use of an adhesive or other permanent coupling means. In addition to the shutter frames, the shutter system also includes at least one hinge that may be used to couple one of the elongate member to a window frame. The shutter system further includes at least one joint that is used to hingedly connect the various frames.

In another embodiment, a method for assembling a window shutter system in accordance with the invention comprises two steps. The method entails assembling at least one frame by connecting a plurality of elongate members using a plurality of couplers. The connections between the elongate members and the couplers are made such that the elongate members and the couplers cannot rotate relative to one another. In addition, the horizontal and vertical sections of the frame can be disconnected and reconnected without the use of an adhesive or other permanent coupling means. The method also entails attaching at least one hinge to the frame for mounting the shutter system to a window.

A technical advantage of the present invention is that a method for assembling a window shutter system is provided. Another technical advantage of the present invention is a modular construction that allows for user customization. Furthermore, shutter systems incorporating teachings of the present invention may be made from plastic, so as to make the shutter systems lightweight and easy to size.

Further technical advantages of the present invention include the ability of the various parts of the shutter system to be interconnected by a male/female connection that provides a secure fit, prevents rotation of the various parts, and can be easily connected and disconnected.

BRIEF DESCRIPTION OF THE DRAWINGS

For a more complete understanding of the present invention, the objects and advantages thereof, reference is now made to the following descriptions taken in connection with the accompanying drawings in which.

DETAILED DESCRIPTION OF THE INVENTION

Figure 1:
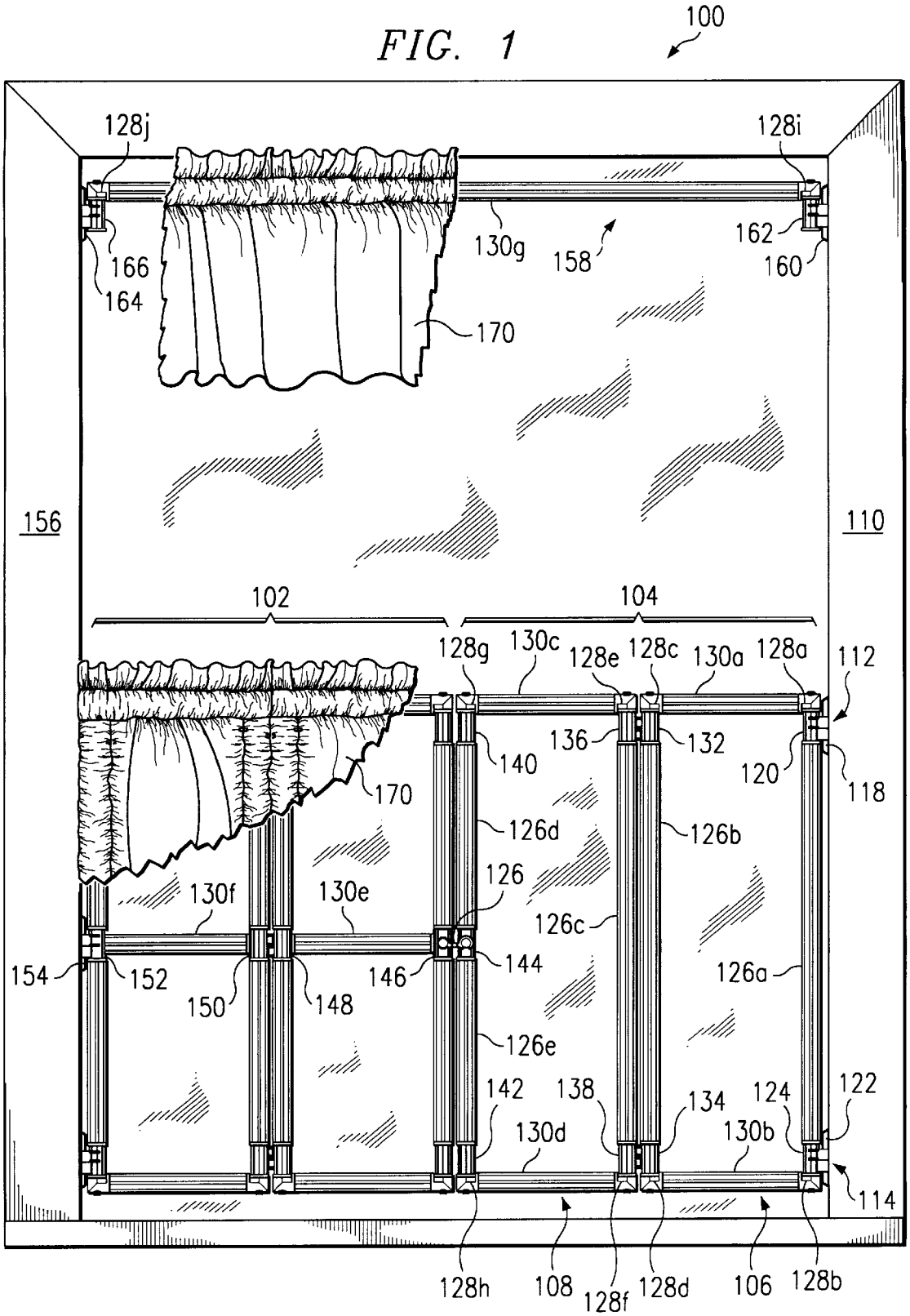
FIG. 1 is a schematic diagram of a window shutter system incorporating teachings of the present invention.
Figure 2:
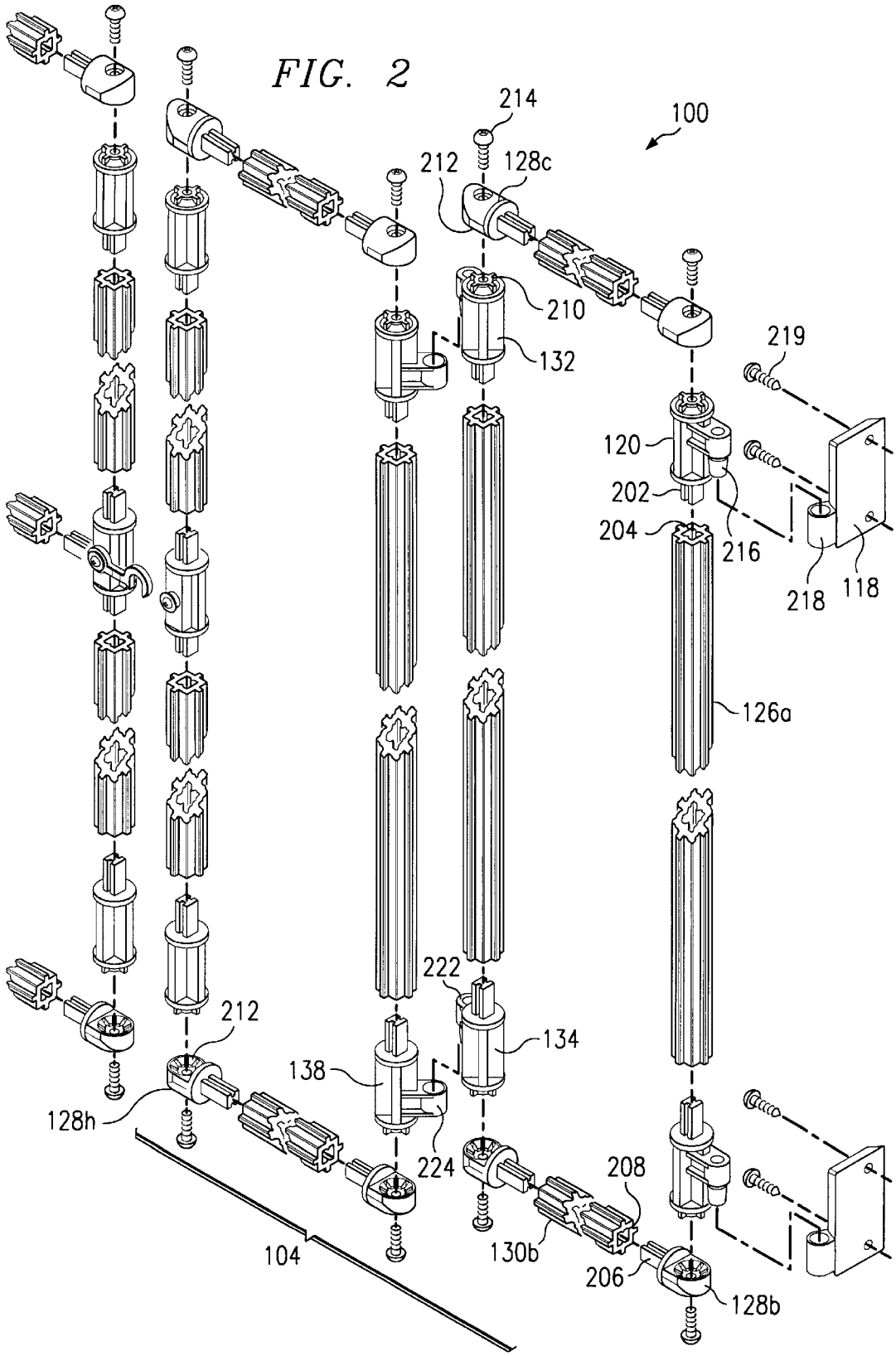
FIG. 2 is an exploded view of a portion of the window shutter system of FIG. 1.

The preferred embodiment of the present invention and its advantages are best understood by referring to FIGS. 1 and 2 of the drawings, like numerals being used for like and corresponding parts of the various drawings.

FIG. 1 is a schematic diagram of a window shutter system 100 incorporating teachings of the present invention. Window shutter system 100 includes a pair of shutter assemblies 102 and 104. Since the configurations of shutter assemblies 102 and 104 are similar, only shutter assembly 104 will be described in detail. It should be noted, however, that shutter assembly 102 is illustrated to include components that comprise an alternate embodiment of the present invention, which is described below.

Shutter assembly 104 is comprised of an outer shutter frame 106 and an inner shutter frame 108. It will be understood, however, that other embodiments of the present invention may include a larger or smaller number of shutter frames. Each shutter frame 106 and 108 is formed of modular and interconnectable components. Outer frame 106 is disposed adjacent a window frame side 110. Outer frame 106 is coupled to window frame side 110 through the use of an upper hinge 112 and a lower hinge 114.

Upper hinge 112 includes an upper wall mount 118 and an upper hinge post 120. Upper wall mount 118 is mounted to window frame side 110. Upper hinge post 120 is coupled to upper wall mount 118. The means by which these components are coupled is described below in conjunction with FIG. 2. Likewise, lower hinge 114 includes a lower wall mount 122 and a lower hinge post 124. Lower wall mount 122 is mounted at a point on window frame side 110 that is lower than the point at which upper wall mount 118 is mounted. Lower hinge post 124 is coupled to lower wall mount 122 as described below in conjunction with FIG. 2. In addition, the interconnections of all other parts of shutter assembly 104 are described in detail below in conjunction with FIG. 2.

A vertical elongate member 126*a* is disposed between and coupled with upper hinge post 120 and lower hinge post 124 such that it is generally parallel to window frame side 110. Vertical elongate member 126*a* and hinge posts 120 and 124 form a vertical section of outer frame 106. Vertical elongate member 126*a* is preferably made of plastic, however other appropriate materials may be used. Vertical elongate member 126*a* also may be sized by the user by cutting away any undesired length. In so sizing, vertical elongate member 126*a* may be fitted to a desired distance between upper hinge 112 and lower hinge 114. Likewise, all other vertical and horizontal elongate members 126 and 130 of shutter system 100 are also preferably made of plastic and also may be sized.

A corner piece 128*a* is connected to the upper end of upper hinge post 120. Likewise, corner piece 128*b* is connected to the lower end of lower hinge post 124. A horizontal elongate member 130*a* is coupled at one end to corner piece 128*a* such that horizontal elongate member 130*a* extends generally perpendicular to vertical elongate member 126*a*. Corner piece 128*c* is coupled to the opposite end of horizontal elongate member 130*a*. Likewise, horizontal elongate member 130*b* is coupled at one end to corner piece 128*b* such that horizontal elongate 130*b* extends generally perpendicular to vertical elongate member 126*a*. Corner piece 128*d* is coupled to the opposite end of horizontal elongate member 130*b*. Horizontal elongate member 130*a* and corner pieces 128*a* and 128*c* form a horizontal section of outer frame 106. Likewise, horizontal elongate member 130*b*and corner pieces 128*b* and 128*d* form another horizontal section of outer frame 106.

It should be noted that the corner pieces 128 are used to transition from the horizontal sections of outer frame 106 to the vertical sections of outer frame 106, and vice versa. Furthermore, the combination of a corner piece 128 and a post, such as upper hinge post 120, form a coupler that can be used to connect a vertical elongate member 128 to a horizontal elongate member 130.

Still referring to FIG. 1, an upper joint post 132 is coupled to corner piece 128*c* such that upper joint post 132 extends downward, generally perpendicular to horizontal elongate member 130*a*. Likewise, lower joint post 134 is coupled to corner piece 128*d* such that lower joint post 134 extends upward, generally perpendicular to horizontal elongate member 130*b*. As is described below, upper and lower joint posts 132 and 134 are used to hingedly connect outer frame 106 to inner frame 108. To complete outer frame 106, vertical elongate member 126*b* is disposed between and coupled to upper and lower joint posts 132 and 134 such that it is generally parallel to vertical elongate member 126*a*.

Shutter assembly 104 also includes inner frame 108. Inner frame 108 is hingedly coupled to outer frame 106 through the use of two joints. Upper joint post 136 of inner frame 108 is hingedly coupled to upper joint post 132 of outer frame 106 to form one joint. Likewise, lower joint post 138 of inner frame 108 is hingedly coupled to lower joint post 134 of outer frame 106 to form the second joint.

Vertical elongate member 126*c* is disposed between and coupled to upper joint post 136 and lower joint post 138. Corner pieces 128*e* and 128*f* are coupled to upper and lower joint post 136 and 138, respectively. As described above, corner pieces 128 serve as a transition from the vertical to the horizontal sections of inner frame 108, and vice-versa.

Horizontal elongate member 130*c* is coupled at one end to corner piece 128*e* such that it extends generally perpendicular to vertical elongate member 126*c*. Likewise, horizontal elongate member 130*d* is coupled at one end to corner piece 128*f* such that it extends generally perpendicular to vertical elongate 126*c*. Corner pieces 128*g* and 128*h* are coupled to the other ends of horizontal elongate members 130*c* and 130*d*, respectively, in order to transition from the horizontal sections to the vertical sections of inner frame 108.

An upper end post 140 is coupled to corner piece 128*g* such that upper end post 140 extends downward, generally parallel to vertical elongate member 126*c*. Likewise a lower end post 142 is coupled to corner piece 128*h* such that it extends upward, generally parallel to vertical elongate member 126*c*. One end of vertical elongate member 126*d* is coupled to upper end post 140 such that vertical elongate member 126*d* is generally parallel to vertical elongate member 126*c*. Likewise, one end of vertical elongate member 126*e* is coupled to lower end post 142 such that vertical elongate member 126*e* is generally parallel to vertical elongate member 126*c*. Vertical elongate members 126*d* and 126*e* extend towards each other, but they do not meet. Disposed between and coupled to vertical elongate members 126*d* and 126*e* is a latching component 144. Latching component 144 may be used in conjunction with a latch 126 to connect shutter assembly 102 with shutter assembly 104.

Although shutter assembly 104 has been described as comprising outer frame 106 and inner frame 108, shutter assembly 104 may also include one or more intermediate frames (not explicitly shown). Such intermediate frames may be coupled between inner frame 108 and outer frame 106 in a similar fashion as inner frame 108 is coupled to outer frame 106. On the other hand, shutter assembly 104 may only include outer frame 106. In such an embodiment, upper end post 140 would replace upper joint post 132, and lower end post 142 would replace lower joint post 134. In addition, vertical elongate member 126*a* could be replaced by vertical elongate members 126*d* and 126*e*, so as to accommodate latching component 144.

Still referring to FIG. 1, shutter assembly 102 illustrates an alternate embodiment of the present invention. In this embodiment, horizontal elongate members 130*e* and 130*f* are added to the above-described assembly to provide additional support to the shutter. In order to accommodate horizontal elongate members 130*e* and 130*f*, various other additional components must be included. Horizontal elongate member 130*e* is disposed between a latching component 146 and an intermediate joint post 148. Intermediate joint post 148 is hingedly coupled to intermediate joint post 150, in a similar manner as the joint posts in shutter assembly 104. Horizontal elongate member 130*f* is disposed between intermediate joint post 150 and an intermediate hinge post 152. Intermediate hinge post 152 is hingedly coupled to intermediate wall mount 154. In this manner, a third hinged connection is made between shutter assembly 102 and a window frame side 156.

As shown in FIG. 1, shutter system 100 may also include a valance 158. Valance 158 is mounted to window frame side 110 through the use of a right wall mount 160. Likewise, valance 158 is mounted to window frame side 156 through the use of left wall mount 164. Right hinge post 162 and left hinge post 166 are hingedly coupled to right wall mount 160 and left wall mount 164, respectively. Corner piece **128*i* is coupled to the top of right hinge post 162. Likewise, corner piece 128*j* is coupled to top of left hinge post 164. A horizontal elongate member 130*g* is disposed between corner pieces 128*i* and 128*j* to complete valance 158. It should be understood that horizontal elongate member 130*g* may be replaced by two separate horizontal elongate members (not explicitly shown). In such an embodiment, one horizontal elongate member is coupled to corner piece 128*i*, and the other horizontal elongate member is coupled to corner piece 128*j*. In this configuration, the horizontal elongate members are permitted to pivot about window sides 110 and 156**.

Still referring to FIG. 1, shutter assemblies 102 and 104 and valance 158 preferably include a fabric covering 170. Fabric covering 170 preferably includes sleeves (not explicitly shown) that fit over the horizontal and vertical elongate members of shutter system 100. When fabric covering 170 is placed over the horizontal and vertical elongate member of shutter assemblies 102 and 104, fabric covering 170 is operable to cover the interior areas of the frames of shutter assemblies 102 and 104. Likewise, fabric covering 170 can be used to cover valance 158. Fabric covering 170 is operable to inhibit the propagation of light and air through a window incorporating shutter system 100.

It should be understood that although shutter system 100 includes valance 158, alternate configurations of the shutter system may have valance 158 replaced by another set of window assemblies 102 and 104. In such a configuration, the window could be almost entirely covered by the shutter system.

Referring now to FIG. 2, illustrated is an exploded view of a portion of window shutter system 100 of FIG. 1. FIG. 2 shows the means by which each part of shutter assembly 104 of shutter system 100 is connected. It should be noted that the various components shown in FIG. 2 are connected in either a hinged or fixed configuration. Each of these means of connection will be described below.

One means of connecting the various components of shutter system 100 is a fixed connection using complimentary male extensions and female receivers. Such a connection is used between the various vertical and horizontal elongate members and the hinge posts, joint posts, end posts, and corner pieces to which they are coupled. For example, vertical elongate member **126*a* is coupled to upper hinge post 120 through the interconnection of an extension 202 with a receiver 204. The cross-sections of extension 202 and receiver 204 are formed such that extension 202 securely fits inside receiver 204**, and such that the relative rotation of the two coupled parts is prevented. The parts are further fastened together using solvent welding or some other suitable fastening technique.

Another example of such a male/female connection is the coupling of horizontal elongate member **130*b* to corner piece 128*b*. In this case, extension 206 of corner piece 128*b* interlocks with receiver 208 of horizontal elongate member 130*b*. The cross-sections of extension 206 and receiver 208** are formed as described above.

A final example of the male/female connections in shutter system 100 is the coupling of upper joint post 132 to corner piece **128*c*. In this case, extension 210 of upper joint post 132 interconnects with receiver 212 of corner piece 128*c*. Receiver 212 can be clearly seen on corner piece 128*h*. The cross-sections of extension 210 and receiver 212 are formed as described above. In one embodiment, extension 210 of joint post 132 (and the extensions of other joint, hinge and end posts) includes a plurality of blades. Receiver 212 of corner piece 128*c* (and the receivers of other corner pieces) likewise includes a plurality of grooves. The grooves are formed so as to accommodate the shape of the blades. When joint post 132 and corner piece 128 are coupled in this embodiment, each blade is inserted into a corresponding groove such that the rotation of joint post 132 relative to corner piece 128*c* is prevented. The orientation of corner piece 128*c* in relation to joint post 132 is dependent upon which blades are inserted into which grooves. In addition to this male/female interconnection, corner piece 128*c* is secured to upper joint post 132 with a fastener 214. Fastener 214 may be a bolt or screw that threads into upper joint post 132, or it may be any other type of fastening means. The above three examples of male/female interconnections represent all the fixed connections of the components of shutter system 100. The means by which the other fixed components of shutter system 100** are coupled can be understood from these examples.

As described above, the cross-sections of the male extensions and female receivers of shutter system 100 are formed such that the relative rotation of the coupled parts is prevented. Although, a particular cross-section is shown in FIG. 2, any cross-section may be used that prevents rotation. Examples include, but are not limited to, rectangular, triangular, and square cross-sections.

The various male extensions and female receivers used to connect the components of shutter system 100 may also incorporate snap-fit connections (not explicitly shown). In such a case, the extension locks into place when it is inserted into the receiver. The operation of such a snap-fit connection is well known in the art and will not be described in further detail here.

Due to the use of the various male/female connections described above, shutter system 100 can be delivered to the user in disassembled modular form. The user can then size the various horizonal and vertical elongate member and then assemble the shutter system by snapping the various components into place. The user can also easily disassemble the system by unsnapping the various components. In this manner, a shutter system is provided that is relatively light weight, inexpensive, and easy to assemble and disassemble.

Shutter system 100 also includes a series of hinged connections. Such hinged connections are represented by the following two examples. The first example is the connection of upper wall mount 118 to upper hinge post 120. Upper hinge post 120 includes a extension arm 216. Extension arm 216 is inserted into a receiver 218 of upper wall mount 118. Extension arm 216 and receiver 218 have complimentary circular cross sections that allow the rotation of extension arm 216 inside receiver 204. Such a connection allows shutter assembly 104 to rotate about the side of a window frame. It should be noted that upper wall mount 118 may be mounted to a window frame (not explicitly shown) with a fastener 219. Fastener 219 may be a bolt, screw, nail, or any other appropriate fastening means.

The second example of a hinged connection in shutter system 100 is the connection of lower joint post 134 to lower joint post 138. Lower joint post 134 includes extension arm 222 that is inserted into a receiver 224 of lower joint post 138. The cross sections of extension arm 222 and receiver 224 are circular so that extension arm 222 may rotate inside the receiver 224. This hinged connection allows the various shutter frames of shutter system 100 to pivot relative to one another about a generally vertical axis. The other hinged connections in shutter system 100 are represented by one of the two examples described above.

In using the window shutter system described in conjunction with FIGS. 1 and 2, the user first identifies the window in which the shutter system is to be placed. The user then determines which components of the shutter system he or she wishes to install on the window. For example, the user may decide the number of frames that will comprise each shutter assembly. In addition, the user may determine whether a valance is to be used. The user then measures the dimensions of the window in which the shutter system is to be placed, and purchases the various components in a size that most closely matches the dimensions of the window. Once the components are obtained, the user may then trim length off the various horizontal and vertical elongate members included in the shutter system to better fit the dimensions of the window. The user then assembles and installs the window shutter system as described above.

In addition, the user may buy a fabric covering to be used with the window system. A separate fabric covering is preferably included for each frame of the window shutter system, and for the valance, if desired. These fabric coverings are typically fabricated so that they will fit over the various shutter frames and valance after the horizonal and vertical elongate members of the frames and valance have been shortened. The fabric covering preferably includes stitched sleeves that can be fitted around the elongate members of the shutter system. In such a case, the user preferably slides the fabric covering over the elongate members before they are coupled together. However, other means, such as Velcro, may be used to allow the user to put the fabric covering on the shutter system after the shutter frames have been assembled and mounted on the window.

While the invention has been particularly shown and described by the foregoing detailed description, it will be understood by those skilled in the art that various other changes in form and detail may be made without departing from the spirit and scope of the invention.

What is claimed is:

1. A window shutter system comprising:

a plurality of elongate members, each elongate member having two ends, each end having a receiver;

a plurality of couplers, each coupler having at least two extensions for connecting adjacent elongate members and adapted to interlock with the receiver of an associated elongate member such that the elongate members and the couplers cannot rotate relative to one another; and at least one hinge operable to connect one of the elongate members to a window frame;

wherein at least one of the couplers comprises a corner piece and a hinge post, the corner piece having a corner piece extension and the hinge post having a first hinge post extension, the corner piece coupled to the hinge post such that the corner piece extension is disposed generally perpendicular to the first hinge post extension;

wherein the corner piece further comprises a receiver having a plurality of grooves, the hinge post further comprises a second hinge post extension that comprises a plurality of blades, and the plurality of blades each fit into a corresponding groove in the receiver of the corner piece to prevent the rotation of the hinge post relative to the corner piece.

2. The window shutter system of claim 1, wherein each blade is configured to fit into any of the plurality of grooves such that the corner piece may be disposed in a plurality of positions relative to the hinge post.

3. A window shutter system comprising:

a plurality of elongate members, each elongate member having two ends, each end having a receiver;

a plurality of couplers, each coupler having at least two extensions for connecting adjacent elongate members and adapted to interlock with the receiver of an associated elongate member such that the elongate members and the couplers cannot rotate relative to one another; and at least one hinge operable to connect one of the elongate members to a window frame;

wherein at least one of the couplers comprises a corner piece and a joint post, the corner piece having a corner piece extension and the joint post having a first joint post extension, the corner piece coupled to the joint post such that the corner piece extension is disposed generally perpendicular to the first Joint post extension.

wherein the corner piece further comprises a receiver having a plurality of grooves, the joint post further comprises a second joint post extension that comprises a plurality of blades, and the plurality of blades each fit into a corresponding groove in the receiver of the corner piece to prevent the rotation of the joint post relative to the corner piece.

4. The window shutter system of claim 3, wherein each blade is configured to fit into any of the plurality of grooves such that the corner piece may be disposed in a plurality of positions relative to the joint post.

5. A window shutter system comprising:

a plurality of elongate members, each elongate member having two ends, each end having a receiver:

a plurality of couplers, each coupler having at least two extensions for connecting adjacent elongate members and adapted to interlock with the receiver of an associated elongate member such that the elongate members and the couplers cannot rotate relative to one another; and at least one hinge operable to connect one of the elongate members to a window frame;

wherein at least one of the couplers comprises a corner piece and an end post, the corner piece having a corner piece extension and the end post having a first end post extension, the corner piece coupled to the end post such that the corner piece extension is disposed generally perpendicular to the first end post extension, wherein the corner piece further comprises a receiver having a plurality of grooves, the end post further comprises a second end post extension that comprises a plurality of blades, and the plurality of blades each fit into a corresponding groove in the receiver of the corner piece to prevent the rotation of the end post relative to the corner piece.

6. The window shutter system of claim 5, wherein each blade is configured to fit into any of the plurality of grooves such that the corner piece may be disposed in a plurality of positions relative to the end post.

7. A window shutter system comprising:

a plurality of shutter frames, each shutter frame having;

a plurality of elongate members, each elongate member having two ends, each end having a receiver; and a plurality of couplers, each coupler having at least two extensions for connecting adjacent elongate members and adapted to interlock with the receiver of an associated elongate member such that the elongate members and the couplers cannot rotate relative to one another;

wherein at least one of the couplers comprises a corner piece and a hinge post, the corner piece having a corner piece extension and the hinge post having a first hinge post extension, the corner piece coupled to the hinge post such that the corner piece extension is disposed generally perpendicular to the first hinge post extension;

wherein the corner piece further comprises a receiver having a plurality of grooves, the hinge post further comprises a second hinge extension that comprises a plurality of blades, and the plurality of blades each fit into a corresponding groove in the receiver of the corner piece to prevent the rotation of the hinge post relative to the corner piece;

at least one hinge operable to couple an elongate member to a window frame, the hinge comprising a hinge post; and at least one joint operable to hingedly connect the plurality of frames.

8. The window shutter system of claim 7, wherein each blade is configured to fit into any of the plurality of grooves such that the corner piece may be disposed in a plurality of positions relative to the hinge post.

9. A window shutter system comprising:

a plurality of shutter frames, each shutter frame having;

a plurality of elongate members, each elongate member having two ends, each end having a receiver; and a plurality of couplers, each coupler having at least two extensions for connecting adjacent elongate members and adapted to interlock with the receiver of an associated elongate member such that the elongate members and the couplers cannot rotate relative to one another;

wherein at least one of the couplers comprises a corner piece and a joint post, the corner piece having a corner piece extension and the joint post having a first joint post extension, the corner piece coupled to the joint post such that the corner piece extension is disposed generally perpendicular to the first joint post extension;

wherein the joint post corner piece further comprises a receiver having a plurality of grooves, the joint post further comprises a second joint post extension that comprises a plurality of blades, and the plurality of blades each fit into a corresponding groove in the receiver of the corner piece to prevent the rotation of the joint post relative to the corner piece;

at least one hinge operable to couple an elongate member to a window frame; and at least one joint operable to hingedly connect the plurality of frames, the joint comprising at least one joint post.

10. The window shutter system of claim 9, wherein each blade is configured to fit into any of the plurality of grooves such that the corner piece may be disposed in a plurality of positions relative to the joint post.

11. A window shutter system comprising:

a plurality of shutter frames, each shutter frame having;

a plurality of elongate members, each elongate member having two ends, each end having a receiver; and a plurality of couplers, each coupler having at least two extensions for connecting adjacent elongate members and adapted to interlock with the receiver of an associated elongate member such that the elongate members and the couplers cannot rotate relative to one another;

wherein at least one of the couplers comprises a corner piece and an end post, the corner piece having a corner piece extension and the end post having a first end post extension, the corner piece coupled to the end post such that the corner piece extension is disposed generally perpendicular to the first end post extension;

wherein the corner piece further comprises a receiver having a plurality of grooves, the end post further comprises a second end post extension that comprises a plurality of blades, and the plurality of blades each fit into a corresponding groove in the receiver of the corner piece to prevent the rotation of the end post relative to the corner piece;

at least one hinge operable to couple an elongate member to a window frame; and at least one joint operable to hingedly connect the plurality of frames.

12. The window shutter system of claim 11, wherein each blade is configured to fit into any of the plurality of grooves such that the corner piece may be disposed in a plurality of positions relative to the end post.

* * * * *